US010072535B2

(12) United States Patent
Stallmann

(10) Patent No.: US 10,072,535 B2
(45) Date of Patent: Sep. 11, 2018

(54) LASH COMPENSATOR SPRING END CAP

(71) Applicant: Schaeffler Technologies AG & Co. KG, Herzogenaurach (DE)

(72) Inventor: John Stallmann, Washington, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 130 days.

(21) Appl. No.: 15/402,576

(22) Filed: Jan. 10, 2017

(65) Prior Publication Data

US 2018/0195420 A1 Jul. 12, 2018

(51) Int. Cl.

| | |
|---|---|
| ***F01L 1/46*** | (2006.01) |
| ***F01L 1/24*** | (2006.01) |
| ***F01L 1/245*** | (2006.01) |
| *F01L 9/02* | (2006.01) |

(52) U.S. Cl.

CPC ..... *F01L 1/2416* (2013.01); *F01L 1/245* (2013.01); *F01L 1/465* (2013.01); *F01L 1/2405* (2013.01); *F01L 1/2422* (2013.01); *F01L 9/023* (2013.01); *F01L 2101/00* (2013.01)

(58) Field of Classification Search

CPC ..... F01L 1/24; F01L 1/2405; F01L 1/2411; F01L 1/2422; F01L 1/245; F01L 2001/256; F01L 1/46; F01L 9/023; F01L 2101/00

USPC ..... 123/90.46, 90.55

See application file for complete search history.

(56) References Cited

U.S. PATENT DOCUMENTS

| | | | | |
|---|---|---|---|---|
| 5,758,613 | A * | 6/1998 | Edelmayer | F01L 1/24 123/90.35 |
| 5,862,785 | A * | 1/1999 | Blowers | F01L 1/2405 123/90.36 |
| 2005/0188938 | A1* | 9/2005 | Masello | F01L 1/2405 123/90.52 |
| 2005/0229887 | A1* | 10/2005 | Sailer | F01L 1/24 123/90.55 |
| 2006/0201466 | A1* | 9/2006 | Schnell | F01L 1/24 123/90.52 |
| 2008/0087244 | A1* | 4/2008 | Sailer | F01L 1/24 123/90.52 |
| 2015/0369087 | A1* | 12/2015 | Nielsen | F01L 1/24 141/1 |
| 2016/0177790 | A1* | 6/2016 | Gudaloor | F01L 1/20 123/90.52 |

* cited by examiner

*Primary Examiner* — Jorge Leon, Jr.
(74) *Attorney, Agent, or Firm* — Matthew V. Evans

(57) ABSTRACT

A lash compensator for a valve train component of an internal combustion engine is provided that includes an end-cap arranged within a reverse-spring control valve assembly of an axially moveable piston. The piston has a first reservoir and an inner radial wall configured with a through-aperture. The reverse-spring control valve assembly has a control valve housing, a bias spring, an end-cap, and a closing body. The end-cap is configured with a cupped end; an inner side of the cupped end receives a second lower end of the bias spring, and an outer side of the cupped end engages an upper portion of the closing body. The end-cap minimizes or eliminates the variation in flow resistance caused by a variation in end-coil geometry of the second lower end of the bias spring.

18 Claims, 5 Drawing Sheets

LASH COMPENSATOR SPRING END CAP

TECHNICAL FIELD

Example aspects described herein relate to lash compensators within a valve train of an internal combustion engine.

BACKGROUND

An internal combustion (IC) typically employs a valve train to convert rotary lift of a camshaft to linear lift of an engine poppet valve to enable a gas exchange process. Precise control of a valve lift event is required for consistent performance, emission control, and durability. To enable such precise control, clearances between valve train components must be maintained throughout the life of the engine. The summation of the clearances between valve train components is typically in the form of a resultant clearance or gap between the tip of the valve and the adjacent valve train component acting on the valve. This resultant clearance, often called "valve lash" must compensate for thermal growth of the valve and wear at each of its two interfaces over the life of the IC engine. Too high of a valve lash can result in unwanted wear, noise and undesirable performance of the engine, while too low of a valve lash can cause the valve to be inadvertently opened when it should be closed.

Valve lash can be mechanically adjusted, for example, by a threaded valve interface and jam nut combination arranged within the valve train component that actuates the valve. However, periodic valve lash adjustments throughout the life of the IC engine must be made to accommodate engine wear.

Many of today's valve trains employ a hydraulically controlled lash compensator that automatically adjusts to the dimensional and thermal variations of the valve train components to provide a zero valve lash condition throughout the life of the IC engine, eliminating the need for periodic valve lash adjustments. A component of the lash compensator is an axially displaceable piston configured with a control valve assembly that manages the exchange of hydraulic fluid between a high pressure chamber and a low pressure reservoir. Different configurations of the control valve assembly are possible. One such configuration is a reverse-spring design shown in FIGS. 12 and 13, contained within a hydraulic pivot element 110. Reverse-spring designs typically employ a bias spring 134 that engages a top portion of a closing body 142 of a control valve assembly 130, providing for a biased-open configuration. Conversely, traditional control valve configurations are configured such that the bias spring 134 engages a bottom portion of the closing body 142, providing for a biased-closed configuration. Reverse-spring designs offer advantages over traditional designs in some instances where inadvertent actuation of the engine poppet valve occurs. Such inadvertent actuation can be caused by camshafts with high base circle runout, dynamic tilt of a camshaft, or a pump-up condition of the lash compensator. Reverse-spring control valve designs depend on tightly controlled design tolerances and clearances to provide for repeatable valve lift events.

Referring to the reverse spring design of FIGS. 12 and 13, engagement of the closing body 142 with a valve seat 144 formed on a bottom surface 131 of the piston 126 occurs when a resultant fluid force F2 acting on the closing body 142 overcomes a bias spring force F3. As evident in FIG. 13, hydraulic fluid flow between the closing body 142 and closing body seat 144 through a flow crevice FC occurs before closure. This flow crevice FC, including the inherent restriction caused by the presence of the bias spring 134, affects the magnitude of the resultant fluid force F2 available to overcome the force F3 of the bias spring 134. The bias spring 134 is typically in the form of a compression spring configured with coils, as shown in FIGS. 12 and 13. Any variation of coil windings, particularly at an end of the bias spring 134 that makes contact with the closing body 142, influences the flow of hydraulic fluid 128 through the flow crevice FC and, thus, the generated fluid force F2. As variation in compression spring end-coil geometry is quite typical with current manufacturing methods, variation of fluid flow forces on the closing body 142 (caused by flow impingement on the spring end-coils) near the flow crevice FC can exist within an engine population of hydraulic pivot elements; this variation in flow induced forces on the closing body 142 near the flow crevice FC can yield a variation in the closing body 142 response time and valve lift amongst the engine valves of an internal combustion engine. As such a variation can negatively impact engine performance and exhaust emissions, a solution is needed to minimize or eliminate bias spring geometry effects on reverse-spring hydraulic lash adjuster performance.

SUMMARY

A lash compensator for a valve train component of an internal combustion engine is provided that includes a central axis and an axially moveable piston assembly arranged within a bore of an outer housing. The piston assembly includes a piston and a control valve assembly. The piston has a first reservoir and an inner radial wall configured with a through-aperture. The control valve assembly has a control valve housing, a bias spring, an end-cap, and a closing body. The control valve housing is configured with at least one fluid port and provides axial guidance to the closing body. A first side of a retaining end of the control valve housing is engaged with a bottom surface of the piston. The bias spring, axially aligned with the through-aperture of the inner radial wall, has a first upper end engaged with the bottom surface of the piston. The end-cap is configured with a cupped end; an inner side of the cupped end receives a second lower end of the bias spring, and an outer side of the cupped end engages an upper portion of the closing body. The closing body can move from a first open position to a second closed position. The end-cap minimizes or eliminates the variation in fluid flow induced forces on the closing body caused by a variation in end-coil geometry of the second lower end of the bias spring. Multiple configurations of end-caps are possible, including, but not limited to embodiments that have a through-hole or piloting land arranged on the cupped end. Several manufacturing methods and corresponding materials can be utilized for the end-cap including stamped metal and injection molded plastic. The piston assembly can be a component within several different valve train components including, but not limited to, a pivot element, valve lifter, tappet, or rocker arm.

A return resilient element can be arranged within the lash compensator such that a third upper end is engaged with a second side of the retaining end of the control valve housing and a fourth lower end is engaged with a bottom surface of the bore of the outer housing. The bottom surface of the piston and the bottom surface of the bore define a high pressure chamber. With the closing body in the first open position, flow of hydraulic fluid between the first reservoir and high pressure chamber is permitted. With the closing body in the second closed position, flow of hydraulic fluid between the first reservoir and high pressure chamber is prevented. In the first open position, the closing body can engage a stop arranged on the control valve housing at an end opposite the retaining end, and in the second closed position, the closing body can engage a valve seat formed on the bottom surface of the piston. The bias spring can bias or forcibly act upon the closing body to the first open position; flow of hydraulic fluid around the closing body and through the through-aperture can generate a fluid force that overcomes the bias spring and moves the closing body to engage the valve seat.

BRIEF DESCRIPTION OF DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
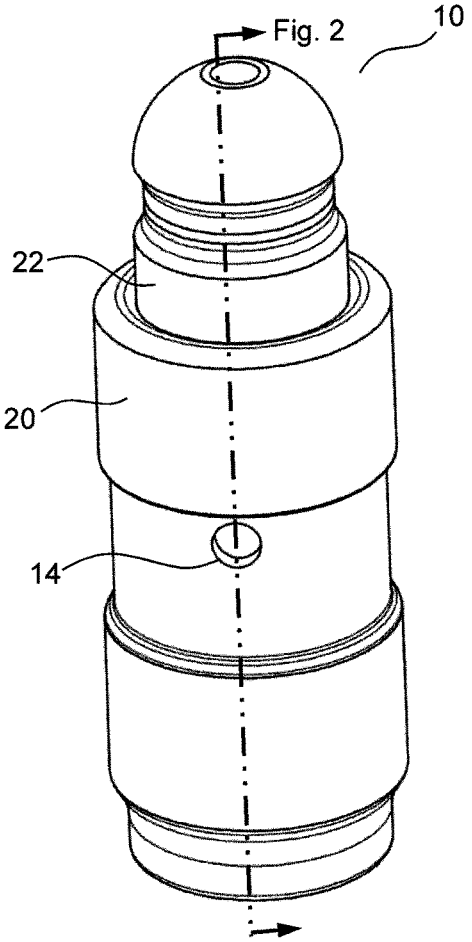
FIG. 1 is a perspective view of a pivot element that includes a hydraulically actuated lash compensator having a piston assembly configured with a reverse-spring control valve assembly that includes an example embodiment of an end-cap arranged between a bias spring and a closing body.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 12:
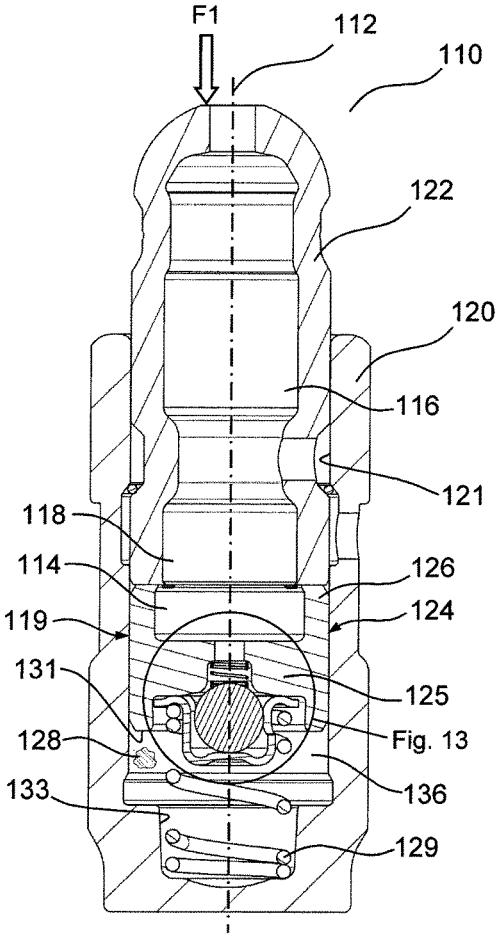
Figure 12 (PRIOR ART)
FIG. 12 is a cross-sectional view of a prior art pivot element configured with a lash compensator having a reverse-spring control valve assembly.
Figure 13:
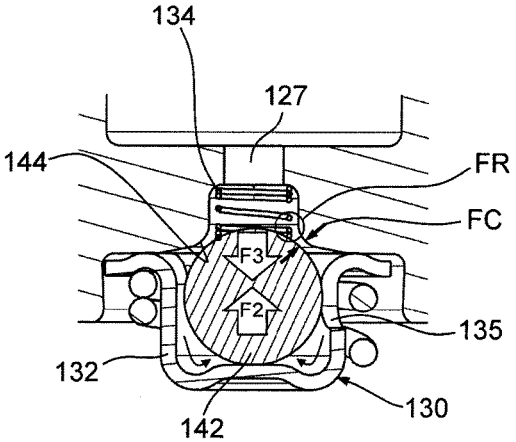
Figure 13 (PRIOR ART)
FIG. 13 is a detailed view taken from FIG. 12.

FIGS. 12 and 13 show a prior art pivot element 110 that includes a hydraulically actuated lash compensator 119 having a piston assembly 124 configured with a reverse-spring control valve assembly 130. The pivot element 110 also includes a central axis 112 and an outer housing 120 with a bore 121. A plunger 122, the piston assembly 124, and a return resilient element or spring 129 are disposed within the bore 121. The piston assembly 124 includes a piston 126, and the control valve assembly 130. The control valve assembly 130 includes a bias spring 134, a closing body 142, and a control valve housing 132. A bottom surface of the piston 131 and a bottom surface of the bore 133 form a high pressure chamber 136 that is typically filled with a hydraulic fluid 128. As a valve train force F1 is applied to the plunger 122, the plunger 122 and piston assembly 124 move axially downward within the bore 121 of the outer housing 120. The compression of the hydraulic fluid 128 causes it to flow from the high pressure chamber 136 to a first reservoir 114 formed in the piston 126, by way of at least one fluid port 135 formed in the control valve housing 132 and a through-aperture 127 formed within an inner radial wall 125 of the piston 126. Hydraulic fluid 128 flows around the closing body 142 and through a flow crevice FC formed between a valve seat 144 and the closing body 142, generating an upward force F2 on the closing body 142. When the fluid generated force F2 exceeds the force F3 of the bias spring 134, the closing body 142 ascends axially until it engages the valve seat 144 formed in a bottom surface 131 of the piston 126. Some of the variables that effect the magnitude of the generated fluid force F2 include hydraulic fluid viscosity, the shape and size of the flow crevice FC, and flow obstacles or resistors in the vicinity of the flow crevice FC. The bias spring 134, typically in the form of a compression spring configured with coil windings, can serve as a flow resistor FR. Any variation of coil windings, particularly at an end of the bias spring 134 that makes contact with the closing body 142 near the flow crevice FC, influences the flow of hydraulic fluid 128 around the closing body 142, and, thus, the generated fluid force F2. Due to a variation in end-coil geometry amongst bias springs 134 contained within a population of pivot elements (or any other valve train component with a lash compensator), a variation of hydraulic fluid flow through the flow crevice FC can result in an inconsistency that yields a corresponding variation in valve lift amongst the engine valves of an internal combustion engine. As such a variation can negatively impact engine performance and exhaust emissions, a solution is needed to minimize or eliminate bias spring 134 geometry effects on reverse-spring hydraulic lash adjuster performance.

FIGS. 1 through 6B show a pivot element 10 that includes a lash compensator 19 having a piston assembly 24 that includes an end-cap 50A arranged within a reverse-spring control valve assembly (RSCVA) 30 to alleviate sensitivity to end-coil geometry of a bias spring 34. The pivot element 10 also includes a central axis 12, an outer housing 20, a plunger 22, a return resilient element or spring 29, and hydraulic fluid 43. The outer housing 20 is configured with a bore 21 and a hydraulic fluid feed aperture 14 that facilitates the flow of hydraulic fluid 43 from a hydraulic fluid source (not shown) to the pivot element 10. The plunger 22, piston assembly 24, and return spring 29, are all disposed within the bore 21 of the outer housing 20. The piston assembly 24 includes a piston 26 and the RSCVA 30. A first reservoir 46 is formed in the piston 26 that, together with a second reservoir 48 configured within the plunger 22, form a low pressure reservoir 49. A bottom surface 41 of the piston 26 and a bottom surface 23 of the bore 21 form a high pressure chamber 31. The RSCVA 30 manages an exchange of hydraulic fluid 43 between the low pressure reservoir 49 and the high pressure chamber 31. A further description of this hydraulic fluid exchange will now be described.

The RSCVA 30 includes a control valve housing 32, a closing body 42, the bias spring 34, and the end-cap 50A. The control valve housing 32, is configured with at least one fluid port 44 and a stop 40 for the closing body 42 arranged at an end opposite a retaining end 38. A first side 39 of the retaining end 38 of the control valve housing 32 is engaged with the bottom surface 41 of the piston 26. The closing body 42 opens and closes a hydraulic fluid passageway in the form of a through-aperture 27 that is arranged in an inner radial wall 33 of the piston 26. A first upper end 35 of the bias spring 34 is engaged with the bottom surface 41 of the piston 26, with the bias spring 34 axially aligned with the through-aperture 27. A second lower end 36 of the bias spring 34 is engaged with an inner side 54A of a cupped end 52A of the end-cap 50A. An outer side 56A of the cupped end 52A of the end-cap 50A is engaged with an upper portion 47 of the closing body 42. The bias spring 34 is arranged to bias the closing body 42 to a first open position with a spring force Fs; in other words, the bias spring 34 engages the closing body 42 and provides a spring force Fs such that the closing body 42 is forcibly engaged with the stop 40 of the control valve housing 32 in a first open position. Those skilled in the art of lash compensators would understand that other forms of the stop 40 are also possible. As the plunger 22 receives a valve train force Fvt that causes it and the piston assembly 24 to move axially downward within the bore 21 of the outer housing 20, hydraulic fluid 43 flows into the at least one fluid port 44 of the control valve housing 32. The hydraulic fluid 43 then flows around and past the closing body 42; through a controlled flow crevice CFC formed between the closing body 42, a valve seat 28, and the end-cap 50A; and, out through the through-aperture 27 into the first reservoir 46. As the plunger 22 receives the valve train force Fvt, with the closing body 42 in the first open position, hydraulic fluid 43 flows from the high pressure chamber 31 to the first reservoir 46 and the plunger 22 and piston 26 descend axially downward within the bore 21 of the outer housing 20. If an axial downward velocity of the plunger 22 and piston 26 is achieved that produces a fluid force Ff greater than the spring force Fs provided by the bias spring 34, the closing body will ascend upward until the closing body 42 engages the valve seat 28, achieving a second closed position. In the second closed position, the magnitude of axial descent of the plunger 22 and piston assembly 24 is a function of a clearance between an outer diameter of the piston 26 and a diameter of the bore 21 of the outer housing 20.

The return resilient element or spring 29 is disposed within the high pressure chamber 31 of the pivot element 10. A third upper end 16 of the return spring 29 is engaged with a second side 45 of the retaining end 38 of the control valve housing 32 and a fourth lower end 18 of the return spring 29 is engaged with the bottom surface 23 of the bore 21. In the absence of the valve train force Fvt, the return spring 29 urges the piston assembly 24 and plunger 22 upward to engage a rocker arm (not shown) in order to maintain a zero-lash condition of the valve train.

The end-cap 50A provides encapsulation of the second lower end 36 of the bias spring 34 which provides a consistent flow path resistance and impingement surface in the area of the controlled flow crevice CFC between the closing body 42 and the valve seat 28. This consistent flow path resistance yields a consistent hydraulic fluid force Ff acting on the closing body 42 for a given fluid velocity. Such a consistent hydraulic fluid force Ff not only reduces or eliminates any variation in engine valve lift within an engine, but also eliminates engine-to-engine variation of valve lift amongst a large population of manufactured lash compensators.

Figure 6A:
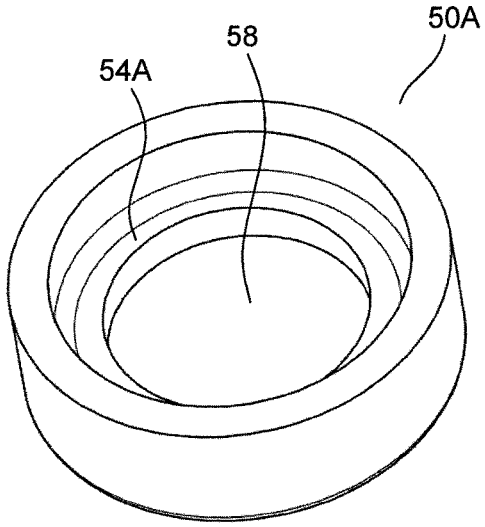
FIG. 6A is an isometric view of the end-cap for the pivot element of FIG. 2.
Figure 6B:
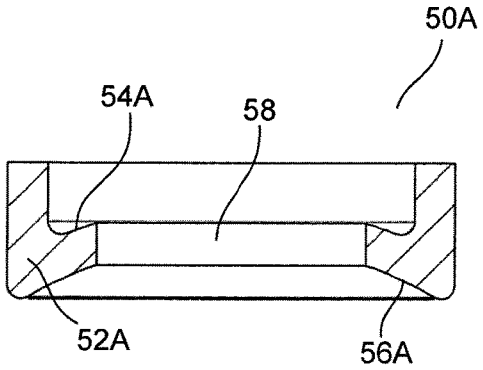
FIG. 6B is a cross-sectional view taken from FIG. 6A.
Figure 7A:
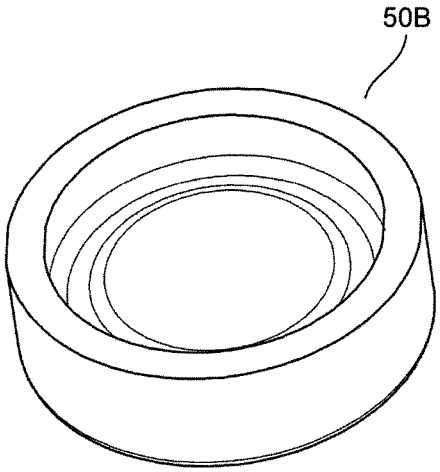
FIG. 7A is an isometric view of an example embodiment of an end-cap for a control valve assembly.
Figure 7B:
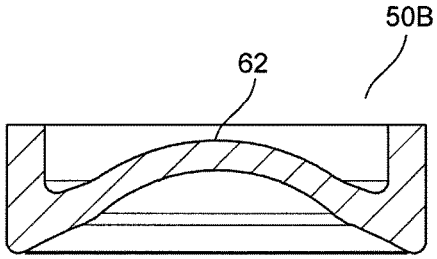
FIG. 7B is a cross-sectional view taken from FIG. 7A.
Figure 8A:
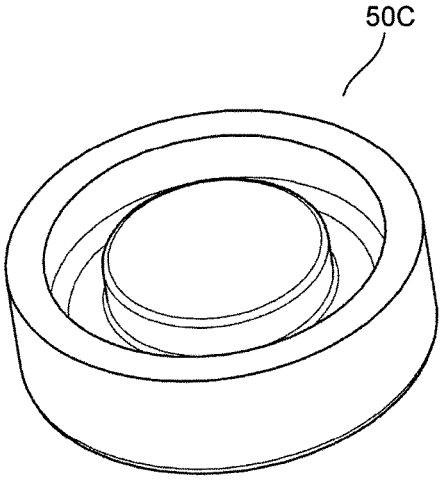
FIG. 8A is an isometric view of an example embodiment of an end-cap for a control valve assembly.
Figure 8B:
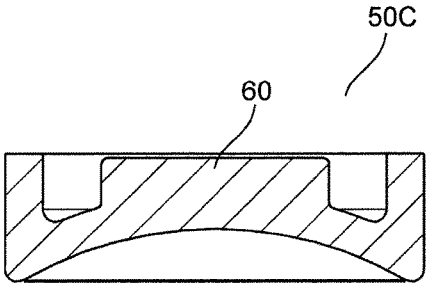
FIG. 8B is a cross-sectional view taken from FIG. 8A.

Referring to FIGS. 6A and 6B, the end-cap 50A is shown with a through-hole 58, however, the end-cap 50A could be configured without the through-hole 58 and still perform its intended function. FIGS. 7A and 7B show an example embodiment of an end-cap 50B without the through-hole 58, but with a domed surface 62 that can serve as a pilot or guidance for the bias spring 34. FIGS. 8A to 8B show yet another example embodiment of an end-cap 50C without the through-hole 58, but with a raised land 60 that can also serve as a pilot for the bias spring 34. Many possible variations of end-cap design are possible to fulfill the described function of eliminating the varying geometry effects of the end-coils of the bias spring 34. Many different manufacturing processes and materials can be utilized for the end-cap 50A-C. Stamping, machining, powdered metal, and injection molding are a sampling of the possible manufacturing processes; while steel, aluminum, and plastic are a sampling of the possible materials.

Figure 2:
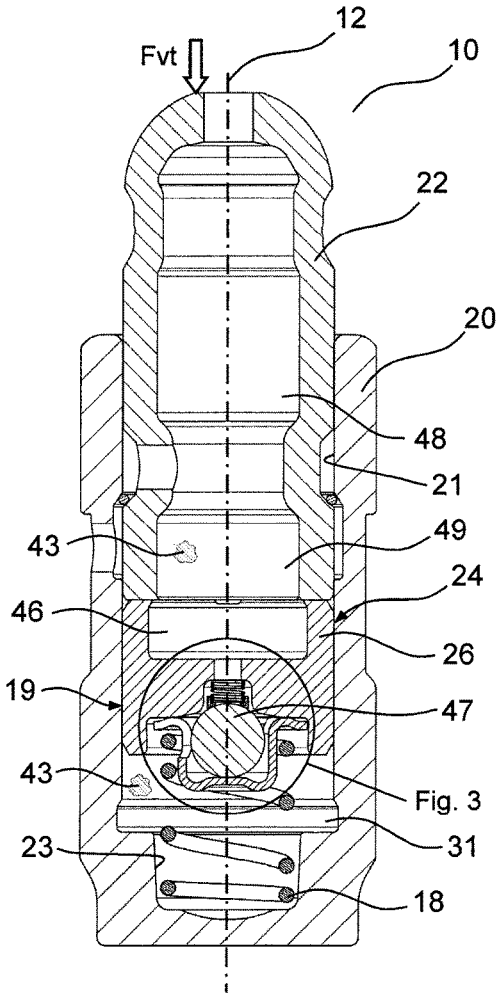
FIG. 2 is a cross-sectional view taken from FIG. 1.
Figure 3:
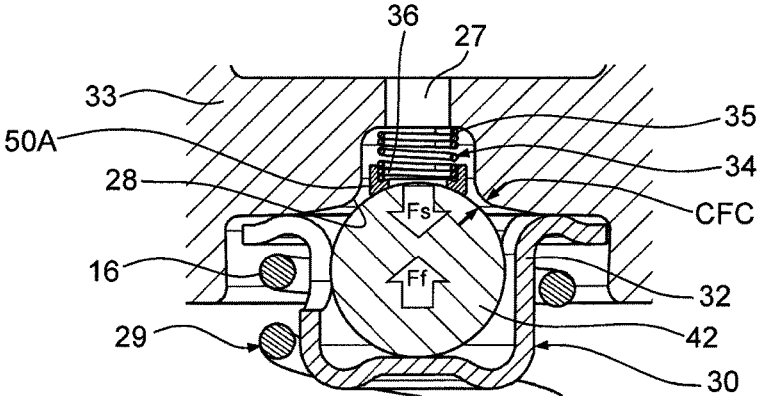
FIG. 3 is a detailed view taken from FIG. 2.
Figure 4:
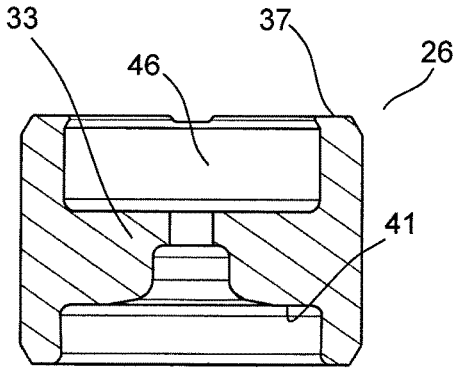
FIG. 4 is a cross-sectional view of a piston for the pivot element of FIG. 2.
Figure 5:
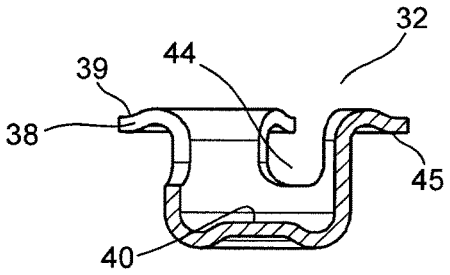
FIG. 5 is a cross-sectional view of a control valve housing for the pivot element of FIG. 2.
Figure 9:
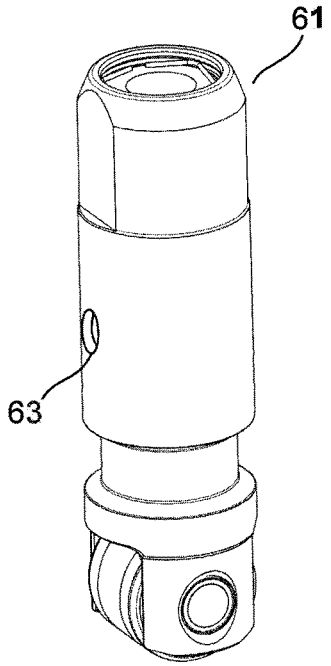
FIG. 9 is an isometric view of a valve lifter configured with a lash compensator.
Figure 10:
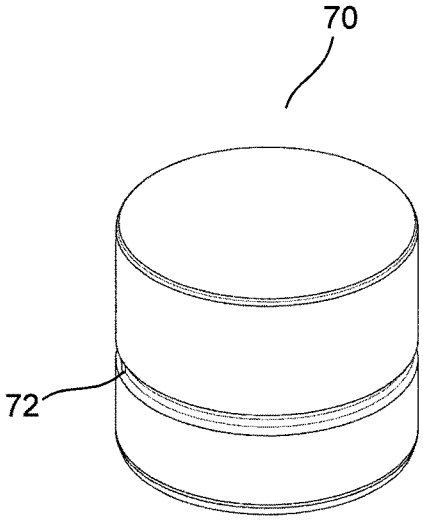
FIG. 10 is an isometric view of a tappet configured with a lash compensator.
Figure 11:
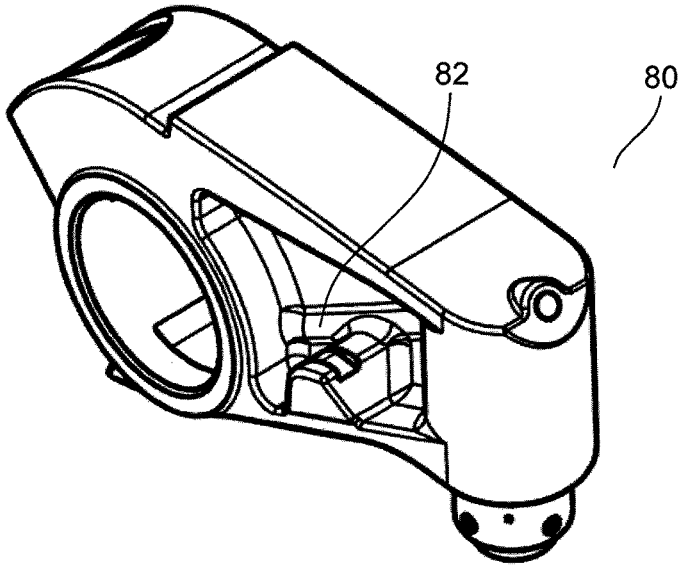
FIG. 11 is an isometric view of a rocker arm configured with a lash compensator.

FIGS. 9-11 show a sampling of valve train components, in addition to the pivot element 10 of FIGS. 1 and 2, which can include the previously described lash compensator 19 with axially displaceable piston assembly 24 and end-cap 50A-C arranged within the RSCVA 30. FIG. 9 shows a valve lifter 61 with a hydraulic fluid feed port 63 for a lash compensator (not shown); FIG. 10 shows a tappet 70 with a hydraulic fluid feed port 72 for a lash compensator (not shown); and, FIG. 11 shows a rocker arm 80 with a hydraulic fluid feed gallery 82 for a lash compensator (not shown).

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

What I claim is:

1. A lash compensator for a valve train of an internal combustion engine comprising:

a central axis;

a piston assembly configured for axial movement within a bore of an outer housing, the piston assembly including:

a piston having:

a first reservoir; and, an inner radial wall configured with a through-aperture; and, a control valve assembly having:

a control valve housing configured with at least one fluid port, a first side of a retaining end of the control valve housing engaged with a bottom surface of the piston;

a bias spring axially aligned with the through-aperture, a first upper end of the bias spring engaged with the bottom surface of the piston; and, an end-cap configured with a cupped end, an inner side of the cupped end receiving a second lower end of the bias spring and an outer side of the cupped end engaging an upper portion of a closing body, including a ball, the closing body axially guided by the control valve housing to move from a first open position to a second closed position.

2. The lash compensator of claim 1, further comprising:

a spring having a third upper end engaged with a second side of the retaining end of the control valve housing and a fourth lower end engaged with a bottom surface of the bore of the outer housing.

3. The lash compensator of claim 2, wherein the bottom surface of the piston and the bottom surface of the bore define a high pressure chamber.

4. The lash compensator of claim 3, wherein the first open position allows flow of hydraulic fluid through the through-aperture between the high pressure chamber and the first reservoir and the second closed position prevents flow of hydraulic fluid through the through-aperture.

5. The lash compensator of claim 4, wherein:

the closing body engages a stop arranged on the control valve housing in the first open position, the stop arranged at an end opposite the retaining end; and, the closing body engages a valve seat formed on the bottom surface of the piston in the second closed position.

6. The lash compensator of claim 1, wherein the bias spring biases the closing body to the first open position.

7. The lash compensator of claim 1, wherein the cupped end of the end-cap is configured with a through-hole.

8. The lash compensator of claim 1, wherein the cupped end of the end-cap is configured with a piloting land.

9. The lash compensator of claim 1, wherein the piston assembly is a component within a valve lifter.

10. The lash compensator of claim 1, wherein the piston assembly is a component within a pivot element.

11. The lash compensator of claim 1, wherein the piston assembly is a component within a rocker arm.

12. The lash compensator of claim 1, wherein the piston assembly is a component with a tappet.

13. The lash compensator of claim 1, wherein the end-cap is made from metal.

14. The lash compensator of claim 13, wherein the end-cap is formed from a stamping process.

15. The lash compensator of claim 13, wherein the end-cap is formed from a powdered metal process.

16. The lash compensator of claim 1, wherein the end-cap is made from plastic.

17. The lash compensator of claim 16, wherein the end-cap is formed from an injection molding process.

18. A lash compensator for a valve train of an internal combustion engine comprising:

a piston assembly configured for axial movement within a bore of an outer housing, the piston assembly including:

a piston having:

a first reservoir; and, a through-aperture arranged within an inner radial wall; and, a control valve assembly having:

a control valve housing configured with at least one fluid port, a first side of a retaining end of the control valve housing engaged with a bottom surface of the piston;

a bias spring axially aligned with the through-aperture, a first upper end of the bias spring engaged with the bottom surface of the piston; and, an end-cap configured with a cupped end, an inner side of the cupped end receiving a second lower end of the bias spring and an outer side of the cupped end engaging an upper portion of a closing body, including a ball;

the closing body axially disposed within and guided by the control valve housing to move from a first open position to a second closed position;

the closing body engaging a stop arranged on the control valve housing in the first open position, the stop located at an end opposite the retaining end; and, the closing body engaging a valve seat formed on the bottom surface of the piston in the second closed position; and a return spring having a third upper end engaged with a second side of the retaining end of the control valve housing and a fourth lower end engaged with a bottom surface of the bore of the housing.

* * * * *